US011044980B1

(12) United States Patent
Jackson et al.

(10) Patent No.: US 11,044,980 B1
(45) Date of Patent: Jun. 29, 2021

(54) NAIL POLISH REMOVAL DEVICE

(71) Applicants: Cheryl Jackson, San Antonio, TX (US); Charea Russell, San Antonio, TX (US)

(72) Inventors: Cheryl Jackson, San Antonio, TX (US); Charea Russell, San Antonio, TX (US)

( * ) Notice: Subject to any disclaimer, the term of this patent is extended or adjusted under 35 U.S.C. 154(b) by 232 days.

(21) Appl. No.: 16/135,077

(22) Filed: Sep. 19, 2018

(51) Int. Cl.
*A45D 29/00* (2006.01)
*A45D 34/04* (2006.01)

(52) U.S. Cl.
CPC ..... *A45D 29/007* (2013.01); *A45D 34/04* (2013.01); *A45D 2200/1018* (2013.01); *A45D 2200/1045* (2013.01)

(58) Field of Classification Search
CPC ..... A45D 29/00; A45D 29/007; A45D 29/11; A45D 29/14; A47K 7/026; A47K 7/04; A61H 15/00; A61H 15/0078; A61H 15/02; B65D 25/54; B65D 25/567
USPC ..... 132/73, 73.5, 73.6, 74.5, 75.8; D28/58; 34/90, 202; 401/219, 220; 15/21.1, 88.3, 15/97.1, 103.5; 4/622, 625, 626; 222/23, 222/154, 155, 156, 157, 158, 159
See application file for complete search history.

(56) References Cited

U.S. PATENT DOCUMENTS 3,439,370 A * 4/1969 Mclaughlin ..... A61B 90/80 15/4
3,612,052 A * 10/1971 Krummenacher ... A61H 35/006 604/23
5,996,163 A * 12/1999 Galizia ..... A46B 5/04 15/104.92
9,609,984 B1 * 4/2017 Kelly ..... A47K 7/04
10,092,077 B1 * 10/2018 Tuttle ..... A45D 29/12
10,117,494 B1 * 11/2018 Luu ..... G21K 5/02
2010/0043137 A1 * 2/2010 Zavan ..... A61H 35/006 4/622

FOREIGN PATENT DOCUMENTS

WO WO-02071889 A2 * 9/2002 ..... A45D 29/007
WO WO-2018102873 A1 * 6/2018 ..... A61H 33/6047

* cited by examiner

*Primary Examiner* — Jacqueline T Johanas
*Assistant Examiner* — Thomas Drew Agger
(74) *Attorney, Agent, or Firm* — Sanchelima & Associates, P.A.; Christian Sanchelima; Alexander Rodriguez

(57) ABSTRACT

A nail polish removal device, especially an efficient toenail polish removal device from a user's feet, is disclosed. The device includes a housing with foot placement assembly having a first area and a second area adapted for receiving the toenails of both feet simultaneously. The device includes a reciprocating sponge assembly, coupled to the foot placement assembly such that the toenails are positioned in contact with the sponge assembly. The device further comprises a filler to receive nail polish removal fluid, which is in fluid communication with the reciprocating and rotating sponge assembly, via one or more tubes, to aid in the removal of nail polish from the toenails of the user's foot. The device further comprises a switch and other electronic components to actuate and reciprocate the sponge assembly, thereby enabling the user to remove the nail polish conveniently without scrubbing the nail polish manually.

9 Claims, 6 Drawing Sheets

NAIL POLISH REMOVAL DEVICE

BACKGROUND OF THE INVENTION

1. Field of the Invention

The present invention generally relates to a nail polish removal device. More specifically, the present invention relates to a toenail polish removal device with a reciprocating sponge assembly having nail polish removing fluid that operates on the toenails, thereby efficiently removing the nail polish from the user's feet simultaneously.

2. Description of the Related Art

Nail polish are used by women as a part of their beauty care, to cosmetically enhance their nails or to protect the nails from everyday conditions. Women use this beauty accessory to match their wardrobe, jewellery and makeup. However, nail polishes exhibit deterioration, particularly in the form of chipping or peeling, in as few as one or two days from being worn. Hence, it is often desirable to quickly remove cosmetic nail polish from fingernails and toenails, such as, for example, prior to applying a new cosmetic finish or once the chipping and peeling starts to progress, resulting in nails which are not only minimally protected from the environment but are unsightly as well. Oftentimes, cleaning and removing polish from one's toenails requires the use of scrub brushes that may also cause damage to user's toe. Further, the use of objects such as sharp bladed instruments or the like that usually fails to remove polish uniformly and the continued use of which can be damaging to one's toenails.

Currently, removal means such as bottle-based systems are used to remove nail polish from finger nails or toenails. Bottle-based nail polish removal systems include a multiple-use bottle containing a relatively large quantity of a nail polish removal solution sufficient for numerous applications. The bottle opens at one end and must be properly secured with a cap to prevent the solution from spilling and evaporation. In use, the solution must be controllably poured from the bottle onto a suitable material, such as a cotton ball or a cloth rag. Once the material is saturated with the nail polish removal solution, the user uses his or her fingers to apply the material to a polished nail in order to remove the nail polish therefrom, thereby undesirably simultaneously exposing other nails to the solution. Bottle-based systems are relatively cumbersome and inconvenient to carry in a pocket or purse; are prone to potential leakage which may damage property and are messy to apply.

Few cosmetic bottles including bottle caps with sponge applicators attached thereto have been made to remove nail polish. The bottle or container need to be squeezed, by which the nail polish removal liquid is applied to the sponge applicator. Then, the user has to scrub with the sponge applicator with a cotton ball wetted with nail polish remover. However, the above described method involves awkward and inconvenient procedure.

Hence, people depends on manicurist for nail polish removal. However, it is difficult to clean one's nails with a degree of cleanliness. Particularly, it is difficult for the users on bending, cleaning and removing toenail polish from the toenails because of back injuries and the like.

Accordingly, it would be desirable and highly advantageous to have a device that will quickly, efficiently and inexpensively, clean and remove polish from the toenails of the user's feet simultaneously. Further, it is desirable to provide a toenail polish removal device that operates on both foot simultaneously in the device.

SUMMARY OF THE INVENTION

It is one of the main objectives of the present invention to provide an efficient and autonomous toenail polish removal device for a user.

It is another objective of the present invention to provide the device that operates on both foot of the user simultaneously.

It is another objective of the present invention to provide the device comprising a housing with a foot placement assembly for allowing the user to place their toenails of the feet in contact with a sponge assembly.

It is another objective of the present invention to provide the sponge assembly that could rotate and reciprocate side by side on the user's toenails.

It is another objective of the present invention to provide the device with a reservoir for holding nail polish removing fluid.

It is still another objective of the present invention to provide the device with a first tube and a second tube from the reservoir to the sponge assembly, wherein the first tube is in fluid communication with the first sponge assembly and the second tube is in fluid communication with the second sponge assembly.

It is still another objective of the present invention to provide the device configured to deliver nail polish removing fluid to sponge assembly through the first tube and the second tube to aid in the removal of fingernail polish from the toenails of a user's foot.

It is yet still another objective of the present invention to provide the device with a tray or a storage container for storing additional nail polish removing liquid.

It is yet still another objective of the present invention to provide the device with a switch that enable the users to turn ON/OFF the device.

Further objects of the invention will be brought out in the following part of the specification, wherein detailed description is for the purpose of fully disclosing the invention without placing limitations thereon.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In some instances, well-known structures, processes and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

Figure 1A:
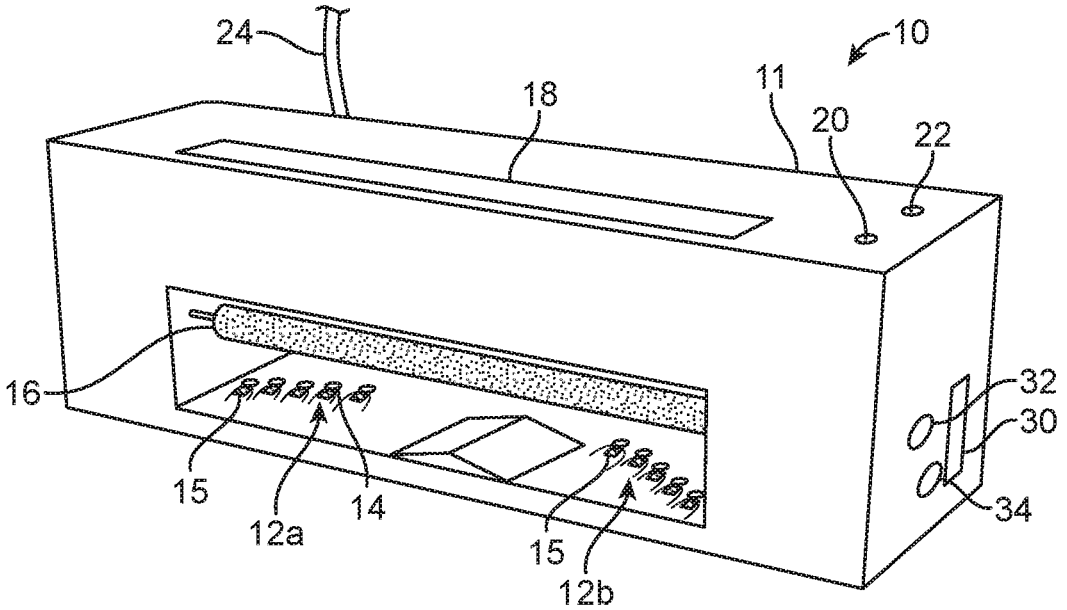
FIG. 1A exemplarily illustrates a perspective view of a nail polish removal device in an embodiment of the present invention.

Referring to FIG. 1A to FIG. 5, a nail polish removal device 10 especially toenail polish removal device and its method of operation is illustrated, according to an embodiment of the present invention. In one embodiment, the nail polish removal device 10 is configured to remove nail polish from the toenails of a user's foot, simultaneously. Referring to FIG. 1A, the nail polish removal device 10 comprises a housing 11. In one embodiment, the housing 11 of the device 10 includes a foot placement assembly, which comprises a first foot placement area or a first area 12*a* and a second foot placement area or a second area 12*b*. The foot placement area (12*a* and 12*b*) enables the user to place their toenails of both foot within the device 10.

In one embodiment, the foot placement area (12*a* and 12*b*) comprises a characteristic shape that conforms to the size and shape of the user's foot. In one embodiment, the foot placement area (12*a* and 12*b*) comprises a shape that outlines the toes and front part of the arch of the foot. In one embodiment, sufficient space is provided between each toe shape so that the user could place their toenails apart comfortably. In one embodiment, the space provided could be 1 to 3 inches. A plurality of cushion members 15 is disposed on the foot placement area (12*a* and 12*b*) such that each toe conforms onto each cushion member 15. A plurality of drainer holes 14 is disposed proximal to the foot placement area (12*a* and 12*b*).

Figure 5:
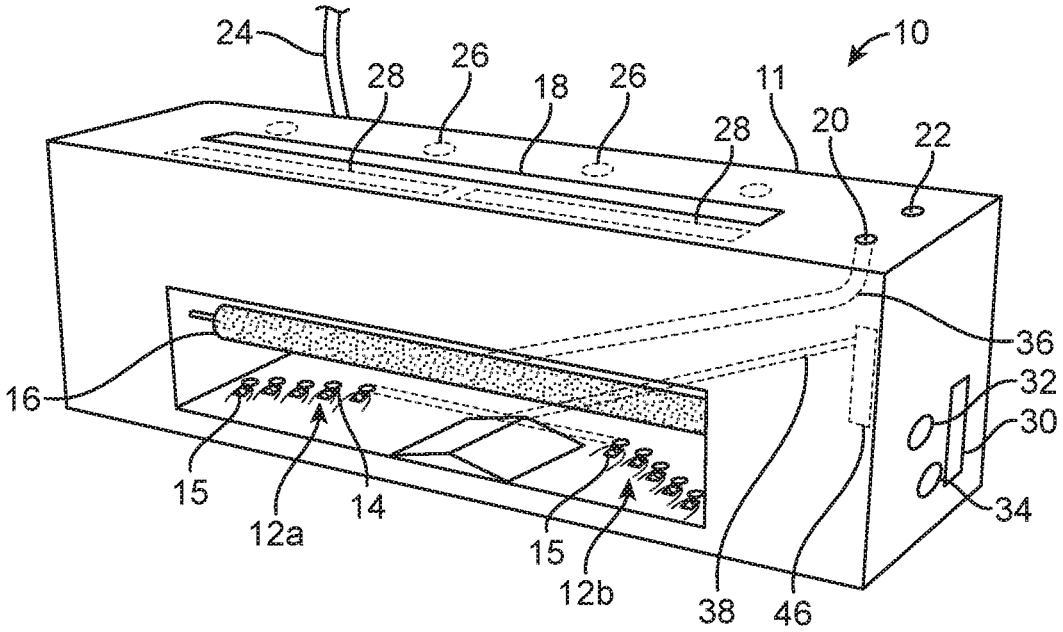
FIG. 5 exemplarily illustrates a see-through view of the nail polish removal device, according to an embodiment of the present invention.

In one embodiment, a filler opening 20 is disposed at a top portion of the housing 11. The filler opening 20 is in fluid communication with a sponge assembly 16, via one or more tubes 36, as shown in FIG. 5. A desired quantity of nail polish removal fluid is then introduced into the filler opening 20, whereby the nail polish removal fluid is delivered to the sponge assembly 16. In one embodiment, the sponge assembly 16 is configured to rotate and reciprocate inside said foot placement area (12*a* and 12*b*) of the foot placement assembly. In one embodiment, the sponge assembly 16 is configured to rotate and reciprocate at a speed sufficient to remove the nail polish from the toenails. The sponge assembly 16 further comprises a sponge support, which is configured to hold and hang the sponge assembly 16 inside the foot placement area (12*a* and 12*b*). In one embodiment, the sponge support could be a support rod. In some embodiments, the material used for sponge assembly 16 is allergen free.

Figure 4:
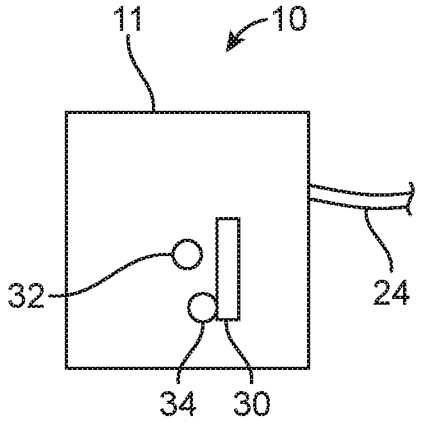
FIG. 4 exemplarily illustrates a side view of the nail polish removal device, according to an embodiment of the present invention.

In one embodiment of the present invention, the device 10 further comprises a nail polish drainer reservoir 46, which is in fluid communication with the one or more holes 14 disposed proximal to the foot placement area (12*a* and 12*b*), via one or more tubes 38, to collect the nail polish residue from the toenails of the user's foot during nail polish removal operation. Referring to FIG. 4, the device 10 comprises an indicator 30 for indicating the level of drained residue collected in the drainer reservoir 46. In one embodiment, the drainer reservoir 46 is connected to an outlet tube 32. In one embodiment, a switch 34 is provided at a side portion of the housing 11 to initiate draining operation to unload the residue from the drainer reservoir 46 via the outlet tube 32.

In some embodiments, the device 10 is made of any material but not limited to light-weight plastic material. The device 10 further comprises a switch 22 for powering the device 10. In one embodiment, the switch 22 is disposed on the top portion of the housing 11. In another embodiment, the switch 22 could be positioned on various location, for example, on a side walls of the housing 11 such way that would be convenient for the user to operate the device 10.

Figure 1B:
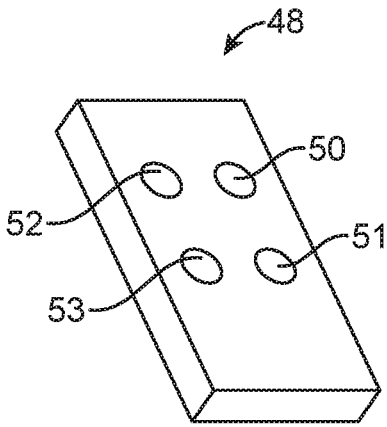
FIG. 1B exemplarily shows a remote control 48 of the present invention.
Figure 2:
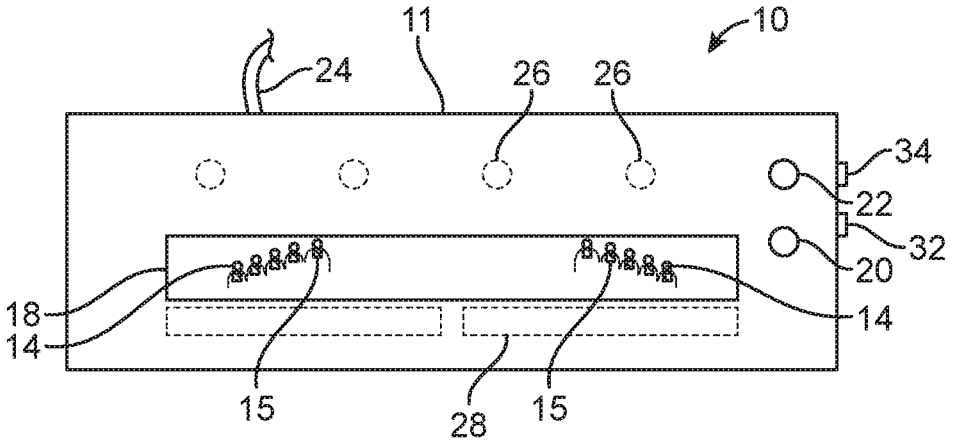
FIG. 2 exemplarily illustrates a top view of the nail polish removal device, according to an embodiment of the present invention.

Referring to FIG. 1B, the device 10 could be conveniently operated using a remote control 48. The remote control 48 comprises control switches (50, 51, 52, 53) to activate and control various operations of the device 10 remotely. Referring to FIG. 2, the device 10 comprises a see through window 18 disposed at the top portion of the housing 11, directly above the foot placement area (12*a* and 12*b*), allowing the user to view or check on the reciprocating operation of the sponge assembly 16.

Referring to FIG. 5, a see-through view of the nail polish removal device 10 is illustrated, according to an embodiment of the present invention. In one embodiment, the device 10 includes a first tube 36 from the filler opening 20 and a second tube 38 from the plurality of drainer holes 14. The first tube 36 is in fluid communication with the sponge assembly 16, and the second tube 38 is in fluid communication with drainer reservoir 46. In one embodiment, the device 10 is configured to deliver nail polish removal fluid from the filler opening 20 to the sponge assembly 16 through the first tube 36. The second tube 38 is configured to collect nail polish residue or nail polish removal fluid residue during cleaning operation from the toenails of the user's foot.

In one embodiment, the device 10 comprises a dryer 28 disposed within the housing 11, directly above the foot placement area (12*a* and 12*b*). The dryer 28 is configured to dry the nail polish removal fluid on the toenails, which could be used after removing the nail polish. In some embodiments, the dryer 28 could be incorporated with a hot air producing mechanism, a lamp for producing heat, or other similar heaters, or an electric fan for blowing heat. In one embodiment, the device 10 further comprises a plurality of LEDs 26 disposed within the housing 11, directly above the foot placement area (12*a* and 12*b*) and proximal to the see through window 18. The plurality of LEDs 26 is configured to emit light within the housing 11.

Figure 3:
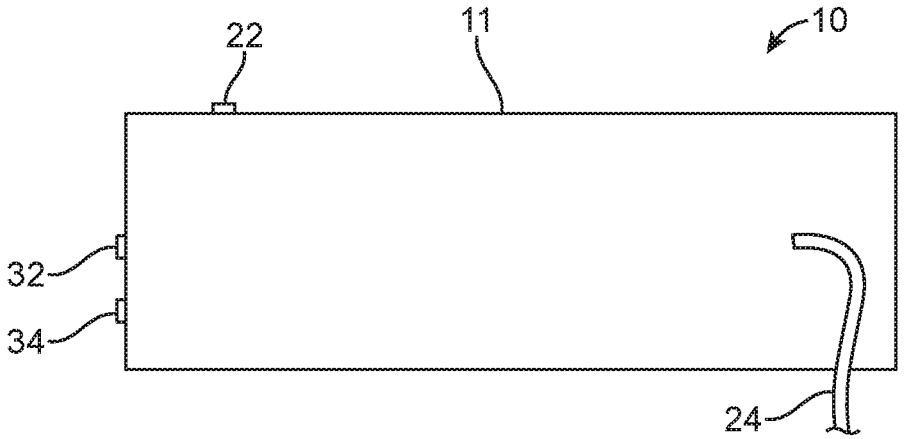
FIG. 3 exemplarily illustrates a rear view of an embodiment of the present invention.

In one embodiment, the device 10 further may comprises a motor assembly for providing rotational and reciprocation movement for the sponge assembly 16. In some embodiments, the device 10 may comprise a battery compartment for receiving one or more batteries to provide one of several possible power sources for the device 10. In some embodiments, the device 10, as an alternative means, could be powered by plugging into a power source. To control the supply of energy of the device 10 and the operation of the device 10, the switch 22 is positioned at the top portion of the housing 11 such that it could be easily actuated by the user. In some embodiments, a power supply cord 24 extends from the housing 11 through a cord hole in a rear side of the housing 11 to supply power to the electrical components or to recharge the battery utilized for device 10, as shown in FIG. 3.

Figure 6A:
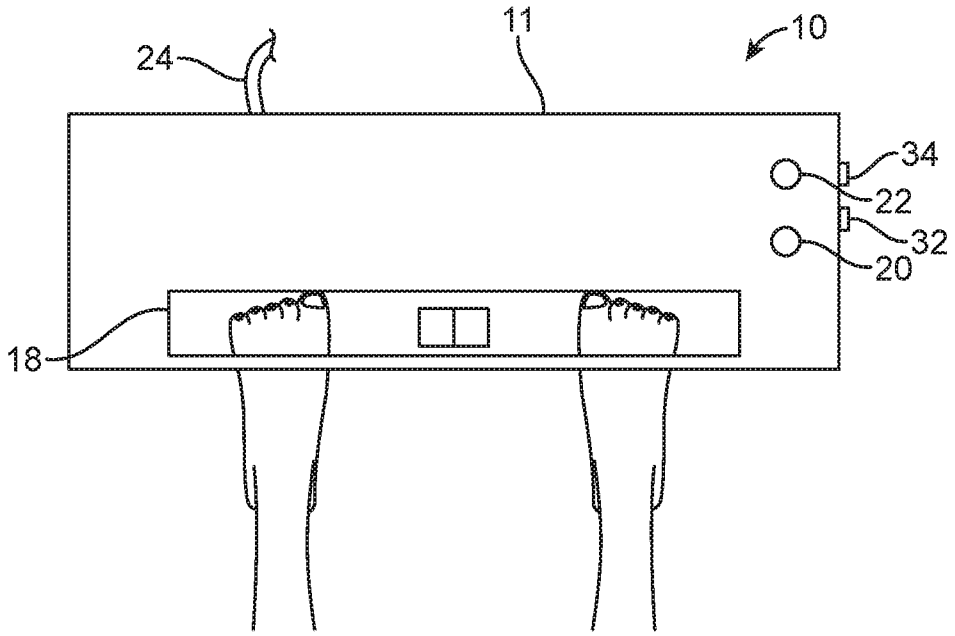
FIG. 6A exemplarily illustrates placement of user's feet within the device, according to an embodiment of the present invention.

Referring to FIG. 6A exemplarily illustrates placement of user's feet within the device 10, according to an embodiment of the present invention. For operating the device 10, each foot of the user needs to be inserted into the first foot placement area 12*a* and the second foot placement area 12*b* of the housing 11, respectively, as best illustrated in FIG. 1A. The foot placement area (12*a* and 12*b*) is configured and sized to support the user's foot. Further, a desired quantity of nail polish removal fluid is then introduced into the filler opening 20, whereby the nail polish removal fluid is delivered to the sponge assembly 16, as best shown in FIG. 5.

Figure 6B:
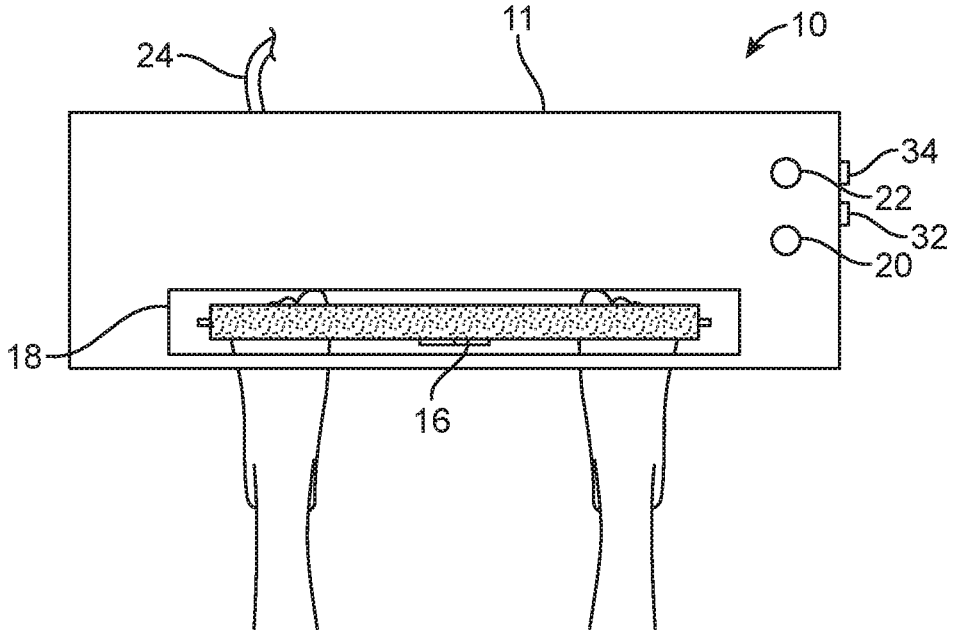
FIG. 6B exemplarily illustrates a top view of an embodiment of the present invention.
Figure 7A:
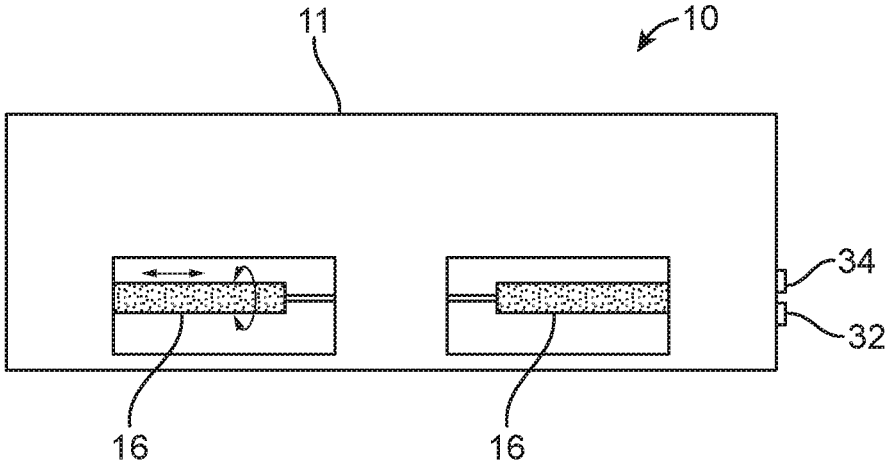
FIG. 7A exemplarily illustrates an embodiment of the present invention showing a sponge assembly 16 for each foot of the user.
Figure 7B:
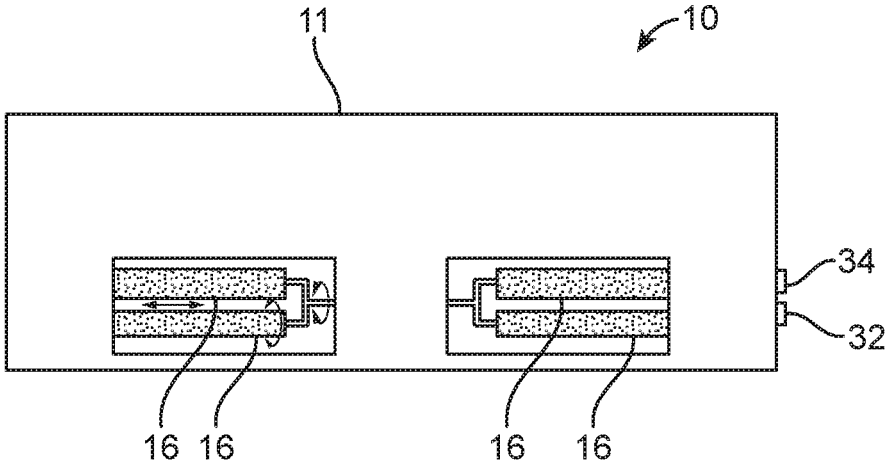
FIG. 7B exemplarily illustrates an alternate embodiment of the present invention showing multiple of sponge assembly 16 for each foot of the user.

Referring to FIG. 6B, after positioning toenails within device 10, the user could depress or actuate the switch 22. On activating the switch 22, the sponge assembly 16 is configured to move towards the foot placement area (12*a* and 12*b*) to rotate and reciprocate in side by side manner or up and down manner on the sponge support. In this position, toenails are either in contact with sponge assembly 16, or positioned such that they could be easily placed in contact with sponge assembly 16. Then, the reciprocating action of the sponge assembly 16 on the toenails enables application of nail polish removing fluid on all over the toenails. The nail polish removing fluid from the sponge assembly 16 removes nail polish completely and rapidly from the toenails of the user's feet. The nail polish residue is collected in the drainer reservoir 46, as best illustrated in FIG. 5. Then, the dryer 28 could be activated to dry the nail polish removal liquid on the toenails, as best show in FIG. 5.

In an alternate embodiment, device 10 may include a motion detector to detect toenails being placed into device 10. Subsequently, sponge assembly 16 may be actuated.

Advantageously, the present invention enables the user to remove nail polish from the toenails of the user efficiently. Further, the device 10 enables the user to remove the nail polish conveniently without any manual means or scrubbing the nails. The device 10 according to the present invention further offers an efficient way to remove nail polish from the toenails, which eliminates the usage of cotton balls to wipe away the nail polish. It also saves time and effort and assist in providing professional pedicure service for the user. The device 10 could be used at homes in person, which reduces the visiting cycle to the salon for removing nail polish. The device 10 further ensures clear and shiny look to the toenails of the user. The plurality of LEDs 26 is configured to provide better visibility of the toenails placed in the foot placement assembly and the operation of the device 10 performed on the toenails via the see through window 18.

Preferred embodiments of this invention are described herein, including the best mode known to the inventors for carrying out the invention. It should be understood that the illustrated embodiments are exemplary only, and should not be taken as limiting the scope of the invention.

The foregoing descriptions comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

What is claimed is:

1. A nail polish removal device, comprising:

a housing including a foot placement assembly, wherein the foot placement assembly includes a foot placement area to receive toenails of a user's feet, said foot placement area located within a slot on a front side of said housing, said slot extending partially along a length of said housing, said housing partially receiving the feet of the user within said slot;

a sponge assembly disposed entirely above the foot placement area and within the slot, said sponge assembly extending partially along the length of said housing;

a filler opening in fluid communication with the sponge assembly disposed at a top portion of the housing, nail polish removal fluid inserted into the filler opening leading into a tube extending between said filler opening and said sponge assembly to deliver said nail polish removal fluid to said sponge assembly;

a dryer disposed within the housing, said dryer being entirely above the foot placement area configured to dry the toenails of the user after removal of nail polish from the toenails of the user, wherein the sponge assembly is configured to move towards the toenails of the user in the foot placement assembly on actuation of the device, said sponge assembly rotates and reciprocates to remove the nail polish from the toenails of both feet of the user simultaneously with said sponge assembly, said dryer being parallel to said sponge assembly;

a motion detector is configured to detect toenails being placed and actuate the sponge assembly;

a plurality of cushion members disposed on the foot placement area configured to provide comfort to the user;

a plurality of drainer holes disposed proximal to the foot placement area; and a nail polish drainer reservoir in fluid communication with the plurality of drainer holes is configured to collect residues produced during the operation of the device, a drainer tube extending between said nail polish drainer reservoir and said drainer holes to interconnect said nail polish drainer reservoir and said drainer holes.

2. The device of claim 1, wherein the sponge assembly includes at least two sponge members, wherein each of said sponge members is supported on a support member.

3. The device of claim 2, further comprises at least two of said sponge members wherein each of said sponge members are supported on an arm branched from the support member.

4. The device of claim 2, further including a water spray nozzle configured to direct water towards the sponge members to facilitate cleaning of the sponge assembly.

5. The device of claim 1, further including:

a see-through window disposed at the top portion of the housing, entirely above the foot placement area is configured to enable the user to view the reciprocation operation of the sponge assembly;

a plurality of LEDs disposed within the housing is configured to emit light within the housing, said plurality of LEDs being parallel to each other and entirely above of said sponge assembly; and a motor assembly is configured to drive the sponge assembly in rotational and reciprocating movement.

6. The device of claim 5, further including:

one or more switches disposed on the housing, wherein at least one switch is configured to enable the user to actuate the device, wherein at least one switch is configured to enable the user to activate the dryer, and wherein at least one switch is configured to enable the user to activate draining operation to unload a residue via an outlet tube in communication with the nail polish drainer reservoir, at least one switch being adjacent to and parallel to said outlet tube;

a remote control to remotely actuate and control the device;

one or more rechargeable batteries in a battery compartment disposed within the housing in communication with the plurality of LEDs, the motor assembly, one or more switches, the nail polish drainer reservoir and the dryer.

7. The device of claim 1, further including a power supply cord extending from the housing through a cord hole at a rear side of the housing to supply power to all electrical components of the device.

8. The device of claim 1, further including an indicator for indicating the level of drained residue collected in the nail polish drainer reservoir.

9. A nail polish removal device, consisting of:

a housing including a foot placement assembly, wherein the foot placement assembly includes a foot placement area to receive toenails of a user feet, said foot placement area located within a slot on a front side of said housing, said slot extending partially along a length of said housing, said housing partially receiving the feet of the user within said slot;

a sponge assembly disposed entirely above the foot placement area and within the slot, said sponge assembly extending partially along the length of said housing, wherein the sponge assembly includes at least one sponge member, wherein each sponge member is supported on a support member;

a filler opening in fluid communication with the sponge assembly disposed at a top portion of the housing configured to receive nail polish removal fluid, a tube extending between said filler opening and said sponge assembly to deliver said nail polish removal fluid to said sponge assembly;

a dryer disposed within the housing, said dryer being entirely above the foot placement area configured to dry the toenails of the user after removal of nail polish from the toenails of the user;

a motor assembly configured to drive the sponge assembly in rotational and reciprocating movement, wherein the sponge assembly is moves towards the toenails of the user in the foot placement assembly on actuation of the device, and rotates and reciprocates to remove the nail polish completely from the toenails of the user;

a plurality of drainer holes disposed proximal to the foot placement area;

a nail polish drainer reservoir in fluid communication with the plurality of drainer holes which are configured to collect residues produced during the operation of the device, a drainer tube extending between said plurality of drainer holes and said nail polish drainer reservoir;

a water spray nozzle configured to direct water towards the at least one sponge member to facilitate cleaning of the sponge assembly;

a plurality of LEDs disposed within the housing configured to emit light within the housing, said plurality of LEDs being entirely above of said sponge assembly; and a power supply cord extending from the housing through a cord hole at a rear side of the housing to supply power to all electrical components of the device.

* * * * *